US005223334A

United States Patent [19]

Green

[11] Patent Number: 5,223,334

[45] Date of Patent: Jun. 29, 1993

[54] ELECTRIC ARC RESISTANT LIGHTWEIGHT FABRICS

[75] Inventor: James R. Green, Hockessin, Del.

[73] Assignee: E. I. Du Pont de Nemours and Company, Wilmington, Del.

[21] Appl. No.: 718,942

[22] Filed: Jun. 21, 1991

Related U.S. Application Data

[63] Continuation-in-part of Ser. No. 528,358, May 25, 1990, abandoned.

[51] Int. Cl.[5] ..... D03D 3/00

[52] U.S. Cl. ..... 428/225; 428/257; 428/258; 428/259; 428/288; 428/373; 428/920; 428/364

[58] Field of Search ..... 428/257, 258, 259, 288, 428/369, 920, 225, 373, 364

[56] References Cited

U.S. PATENT DOCUMENTS

| | | | |
|---|---|---|---|
| 4,198,494 | 4/1980 | Burckel | 525/432 |
| 4,569,088 | 2/1986 | Frankenburg et al. | 2/81 |
| 4,750,443 | 6/1988 | Blaustein et al. | 112/420 |
| 4,869,947 | 9/1989 | Kirayoglu | 428/198 |
| 4,920,000 | 4/1990 | Green | 428/288 |
| 4,941,884 | 7/1990 | Green | 8/120 |

OTHER PUBLICATIONS

Ivanova et al, "Specificity of Oxidative Thermal Decomposition and Combustion of Fabrics from Fiber Blend", Khim. Volokna, (2), 40–2, 1990, full article of.

*Primary Examiner*—James J. Bell

[57] ABSTRACT

Woven fabrics wherein the warp yarns contain specified amounts of heat resistant fibers blended with cotton fiber provide protection against radiation given off by electric arcs.

6 Claims, No Drawings

ELECTRIC ARC RESISTANT LIGHTWEIGHT FABRICS

BACKGROUND OF THE INVENTION

This is a continuation-in-part of my application Ser. No. 07/528,358 filed May 25, 1990 is now abandoned.

Clothing made from flame resistant fibers provide electrical workers protection from the intense radiation given off by powerful electric arcs which may pass near them in accidental discharge in high voltage equipment. However, such garments when made from flame retardant cotton (FR cotton) are uncomfortable in warm environments because of the heavyweight fabric required for adequate protection. The garments can be lighter and still offer adequate protection if made from certain flame resistant synthetic fibers but such garments are also uncomfortable because of reduced water absorption as compared with FR cotton. Clearly lightweight fabrics with improved shielding from electric arcs are needed for electrical workers to provide comfort and protection.

SUMMARY OF THE INVENTION

This invention provides woven fabrics having a basis weight of 135–203 g./m$^2$ and which are suitable for use in clothing having high resistance to radiant energy from high voltage electric arcs and yet offer a high degree of comfort to the wearer comprising warp yarns of 15–50% heat resistant staple fibers having a Limiting Oxygen Index (LOI) of at least 25, and 50–85% of flame retardant cotton and fill yarns of 0–50% heat resistant staple fibers and 50–100% of flame retarded cotton, the said yarns having a linear density of 215–550 dtex.

DETAILED DESCRIPTION OF THE INVENTION

The stable fibers used herein are textile fibers having a linear density suitable for wearing apparel, i.e. less than 10 decitex per fiber, preferably less than 5 decitex per fiber. Still more preferred are fibers that have a linear density of from about 1 to about 3 decitex per fiber and length from about 1.9 to 6.3 cm (0.75 to 2.5 in). Crimped fibers are preferred for textile aesthetics and processibility.

By "heat resistant" is meant fibers which have a heat resistance time measured as described herein of at least 0.018 sec/g/m$^2$ (0.6 sec/oz/yd$^2$). For comparison, flame retarded cotton has an LOI of 30 but a heat resistance time of only 0.01 sec/g/m$^2$ and is considered flame resistant (LOI>25) but not heat resistant.

A process for making the fabrics of the invention involves the steps of first preparing a blend comprising 15–50% heat resistant staple fibers and 50–85% cotton. Single ply yarns of from 195 to 500 dtex (nominal 12 to 30 cotton count [cc] are spun from the blend and 118–187 gm/m$^2$ (3.5–5.5 oz/yd$^2$) basis weight fabric is woven using these yarns as the warp and a fill produced using a blend of 0–50% heat resistant fibers and 50–100% cotton. Yarns of lower linear density can be plied to achieve the same linear density.

The fabrics are then treated with commercially available flame retardants such as "Proban CC" from Abright & Wilson Inc., P. O. Box 26229, Richmond, VA or "Pyrovatex CP" from Ciba-Geigy. Both treatments are described in *Japanese Textile News.* No. 394, September, 1987. Basis weight after flame retarding is 135 to 203 gm/m$^2$ (4–6.0 oz/yd$^2$) and yarn linear densities are 215 to 550 dtex.

The amount of heat resistant fibers required in the fill direction in fabric of the invention depends upon the fabric construction. In plain weave fabrics, at least 15% heat resistant fibers and up to 85% cotton is needed in the fill whereas in 2×1 and 3×1 twill fabrics, the fill can be all FR cotton. Too little heat resistant fiber in the warp can result in fabric break open upon exposure to an electric arc caused by discharge of high voltage equipment. On the other hand, an excess of heat resistant fiber results in a loss of desirable cotton aesthetics and higher costs.

It has been found that with 2×1 and 3×1 twills, heat resistant fibers need be present only in the warp yarns, that is, the fill yarn may be all cotton. Severe break open will be avoided provided that the warp faces the arc, i.e., is at the surface of the garment away from the wearer. In the reverse condition, with the warp face away from the arc and 100% FR cotton fill exposed, fabrics will have severe break open even though there is an adequate amount of heat resistant fibers in the warp. With adequate amounts of heat resistant fiber in both warp and fill, fabrics will resist break open from either direction. It is believed that the ability of 2×1 and 3×1 twills having 100% FR cotton fill yarn to survive is due to the longer warp float which shields the fill yarn and absorbs the radiation preferentially in the surface exposed to the arc. While 2×1 twills are superior to plain weave in that they meet the criteria for minimal fabric break open, 3×1 left hand twills are even more preferred because they experience no break open even with fill yarn of 100% cotton. This is thought to be due to the longer float of the 3×1 versus 2×1 twill and the elasticity imparted by the "z" twist yarns in the left hand construction.

Fabrics of the invention containing blends of FR cotton and heat resistant fibers provide better protection from the blast and heat from an electric arc than presently available commercial fabrics of equal basis weight made entirely of synthetic flame resistant fibers.

Table 1 shows that under severe and moderate exposure conditions, fabrics of the invention performed as well as heavier poly(m-phenylene isophthalamide), (MPD-I)/poly(p-phenylene terephthalamide) (PPD-T) 95/5% fiber blend fabrics, and better than flame retarded cotton fabrics used in garments commonly worn by electrical workers.

It is important that the yarns employed in fabric of the invention not exceed 550 dtex since the use of such heavy yarns in lightweight fabrics results in undesirably open fabric and inadequate protection to the wearer. If the yarn size is less than 215 dtex, fabric thickness of the lightweight fabric will be inadequate to protect against damage from absorbed radiation, and the fabric will break open.

The fibers can be spun into yarns by a number of different spinning methods, including but not limited to ring spinning, air-jet spinning and friction spinning and can be intimate blends or sheath-core.

An exemplary heat resistant fiber for use in the present invention is poly(p-phenylene terephthalamide) (PPD-T) (LOI 28, heat resistance time of 0.04 sec/g/m) staple fiber. This fiber can be prepared as described in U.S. Pat. No. 3,767,756 and is commercially available.

Other heat resistant organic staple fibers may be used including, but not limited to, the following: fiber of a copolymer of terephthalic acid with a mixture of diamines comprising 3,4'-diaminophenyl ether and p-phenylenediamine as disclosed in U.S. Pat. No. 4,075,172 (LOI 25, heat resistance time 0.024 sec/g/m). Polybenzimidazole is also suitable (LOI 41, heat resistance time 0.04 sec/g/m).

Test Measurements

Arc-Resistance Test

The test for measuring resistance to an arc consists of exposing fabrics in air to an electric arc which is generated by applying 15,000 volts to two electrodes spaced one foot apart. A small copper wire connecting the electrodes is employed for arc initiation. Once the arc is initiated, voltage is decreased to an average of 500 volt RMS (root mean square) and a current flow of 8,000 amps RMS using 60 cycle alternating current is applied for one-sixth second.

Two levels of exposure were used. In the more severe test, samples (30×30 cm) are held in a frame at a distance of 15 cm from the arc. Only 20×20 cm of the sample is exposed to the arc by virtue of a 0.08 cm thick stainless steel plate 30×30 cm with a 20×20 cm opening in the middle being mounted on the frame facing the arc. The test specimen, is clamped between the stainless steel plate, a 0.63 phenolic spacer (constructed like the stainless plate) and a 0.08 cm which copper plate. This provides a 0.63 cm air space between the test speciment and the copper plate. For testing under moderate exposure, shirts made from the fabrics are placed over a mannequin clothed in a 100% cotton tee-shirt and spaced at a distance of 20 cm. from the arc.

To pass the arc resistance test, the fabric or shirt must not form a split of more than 7.5 cm in length or 0.75 cm wide. If more than two splits occur or if either the tee-shirt or the outer shirt ignites, the sample has failed the test.

Heat Resistance Time

Heat Resistance Time is measured using a device described in U.S. Pat. No. 4,198,494 for measurement of Fabric Break Open. The same heating conditions are used but as in the aforementioned patent, the sample holder was modified to expose 2.5×6.3 cm area of the test sample (a strip 2.5×2.5 cm) to the heat flux. The test sample is placed under a tensile load of 1.8 kg by holding one end fixed and attaching the other to a 1.8 kg weight suspended with a string over a pulley. Measurements are made with the fabric loaded in the warp direction only, and with the fabric face down against the flame. The time recorded is the time required for the sample to break. Time in seconds before the sample breaks divided by the basis weight of the fabric ing/m is reported as Heat Resistance Time. This type of heating device is available as model CS-206 from Custom Scientific Instruments, Inc., 13 Wing Drive, Cedar Knolls, NJ 07927.

For the determination of heat resistance time fabrics from staple or continuous filament yarn may be used. Plain weave fabric with substantially equal numbers of ends and picks of the same yarns should be used. The fabric basis weight should be between 170 and 340 g/m (5–10 oz/yd).

Limiting Oxygen Index

This was determined using ASTM Method d2863-77.

EXAMPLE 1

An arc resistant fabric of the present invention was prepared from ring-spun yarns of intimate blends of PPD-T staple fibers and cotton.

A picker blend sliver of 30% of PPD-T fibers having a linear density of 1.65 decitex (1.5 dpf) of a cut length of 3.8 cm (1.5 in), and 70% carded cotton was processed by the conventional cotton system into a spun yarn having 7.3 turns per cm of "z" twist (18.5 tpi) using a ring spinning frame. The yarn so made was a 272 dtex (nominal 21.5 cotton count; 247 denier) singles spun yarn which was used as the warp on a shuttle loom in a 3×1 left hand twill construction with a singles ring spun fill yarn made from 100% cotton having the same twist and linear density as the warp yarn. The twill fabric had a construction of 30 ends per cm ×19 picks per cm (76 ends per in. ×47 picks per in.), a basis weight of 162 g/m (4.8 oz/yd ). The fabric was dyed blue and then treated with and aqueous solution of a 2:1 mole ratio tetrakis (hydroxymethyl) phosphonium chloride (THPC)/urea condensate, a flame retardant available as "Proban CC" from Abright F. Wilson. The fabric was made into a shirt and placed on a mannequin 20 cm from the electric arc with the warp facing the arc. The shirt did not break open or ignite and the tee-shirt did not ignite when given the moderate exposure arc resistance test. When the shirt was turned inside-out, with the cotton fill facing the arc, and given the same test, it split vertically along the entire length of one side, opening up to about 1.25 cm.

EXAMPLE 2

A 3×1 right hand twill fabric was constructed in which the warp yarn of Example 1 was used in both the warp and fill directions. After treatment with flame retardant, this fabric also passed the arc resistance test (moderate exposure) when tested as a shirt on a mannequin 20 cm from the arc.

EXAMPLE 3

A 2×1 right hand twill was constructed using the warp yarn of Example 1 and a 100% cotton fill yarn having a linear density of 354 dtex (nominal cotton count 16.5 cc, 322 denier). The fabric had a construction of 30 ends per cm, 14 picks per cm (76 ends per in. ×36 picks per in.) and a basis weight of 162 g/m (4.8 oz/yd ). When a shirt of this fabric (after flame retarding) was exposed with the warp face out on a mannequin 20 cm from the arc and subjected to the arc resistance test, there were only two small splits, no after flame and no tee-shirt ignition. When turned inside-out, the shirt fabric failed by excessive break open.

EXAMPLE 4

A 3×1 right hand twill fabric was made in a manner similar to the fabric of Example 2. Yarns with 50% PPD-T and 50% cotton were used for both the warp and fill. The fabric tested as a shirt (warp face out) on a mannequin 20 cm from the arc passed the arc resistance test.

EXAMPLE 5

A fabric similar to that of Example 1 was prepared except that the fill yarn linear density was 354 dtex (nominal cotton count 16.5, 322 denier). The fabric had a construction of 30 ends per cm, 16 picks per cm (76 ends per in. z 41 picks per in.) and a basis weight of 179 g/m (5.3 oz/yd ) . The fabric passed the arc resistance test when tested as a shirt on a mannequin 20 cm from the arc.

EXAMPLE 6

A Plain weave fabric was constructed in which both the warp and fill yarns were blends of 15% PPD-T/85% cotton and the linear density of the warp and fill yarns was 390 dtex (15 cc, 354 denier). The fabric was dyed green and had a construction of 21 ends per cm x 20 picks per cm (54 ends per in. ×50 picks per in.) and a basis weight of 203 g/m (6.0 oz/yd). The fabric passed the more severe arc resistance test when held in a frame 15 cm from the arc.

TABLE 1

Arc Test Comparison of Examples of the Invention and Controls

| | Basis Wt. gm/m | Test Result |
|---|---|---|
| Moderate Exposure - Mannequin 20 cm From Arc | | |
| MPD-I/PPD-T (95/5%) | 203 | PASSED |
| 100% FR Cotton | 203 | FAILED |
| Examples 1–4 | 162 | PASSED |
| Example 5 | 179 | PASSED |
| Severe Exposure - Frame 15 CM From Arc | | |
| 100% FR Cotton | 203 | FAILED |
| Plain Weave PPD-T/FR Cotton 50/50% Warp 100% FR Cotton Fill | 291 | FAILED |

TABLE 1-continued

Arc Test Comparison of Examples of the Invention and Controls

| | Basis Wt. gm/m | Test Result |
|---|---|---|
| Example 6 | 203 | PASSED |

I claim:

1. A woven fabric having both warp and fill yarns and a basis weight of 135 to 203 g./m suitable for use in clothing having resistance to radiant energy from electric arcs yet offering a high degree of comfort to the wearer comprising warp yarns which contain a blend of 15–50% heat resistant staple fibers having a Limited Oxygen Index of at least 25 and 50–85% of flame retardant cotton and fill yarns comprising 0 to 50% of heat resistant fibers and 50 to 100% of cotton in the case of 2×1 and 3×1 twill fabrics and 50 to 85% of cotton in the case of plain weave fabrics, the yarns having a linear-density of 215-550 dtex.

2. The woven fabric of claim 1 wherein the heat resistant fiber is poly(p-phenylene terephthalamide).

3. The woven fabric of claim 1 where the construction is a 3×1 twill.

4. The woven fabric of claim 3 where the yarn construction is a 3×1 left hand twill and the fill is 100% flame retardant cotton.

5. The woven fabric of claim 1 wherein the construction is a 2×1 twill.

6. The woven fabric of claim 1 where the construction is plain weave and the fill yarns contain a blend of at least 15% heat resistant fibers and from 50% to 85% flame retardant cotton.

* * * * *